United States Patent [19]

Wanou et al.

[11] Patent Number: 5,060,016

[45] Date of Patent: Oct. 22, 1991

[54] PROCESS UNIT FOR IMAGE FORMING APPARATUS, INCLUDING A CHARGING BRUSH

[75] Inventors: Masahiro Wanou, Kawasaki; Kunihiko Sato, Hadano; Masatoshi Kimura, Ebina; Junzo Nakajima, Yokohama, all of Japan

[73] Assignee: Fujitsu Limited, Kawasaki, Japan

[21] Appl. No.: 219,489

[22] Filed: Jul. 15, 1988

[30] Foreign Application Priority Data

Jul. 15, 1987 [JP] Japan ..... 62-177678

[51] Int. Cl.[5] ..... G03G 15/02

[52] U.S. Cl. ..... 355/219; 355/210

[58] Field of Search ..... 355/200, 210, 219, 221, 355/225

[56] References Cited

U.S. PATENT DOCUMENTS

| | | | |
|---|---|---|---|
| 4,336,565 | 6/1982 | Murray et al. | 355/219 X |
| 4,387,980 | 6/1983 | Ueno et al. | 355/219 |
| 4,455,078 | 6/1984 | Mukai et al. | 355/219 |
| 4,457,615 | 7/1984 | Seanor | 355/219 |
| 4,494,857 | 1/1985 | Ueno et al. | 355/219 X |
| 4,538,896 | 9/1985 | Tajima et al. | 355/200 |
| 4,540,268 | 9/1985 | Toyono et al. | 355/210 |
| 4,547,060 | 10/1985 | Lindblad | 355/219 |
| 4,575,221 | 3/1986 | Onoda et al. | 355/200 |
| 4,706,320 | 11/1987 | Swift | 355/219 X |
| 4,839,690 | 6/1989 | Onoda et al. | 355/219 X |

FOREIGN PATENT DOCUMENTS

| | | |
|---|---|---|
| 56-114978 | 9/1981 | Japan . |
| 58-190968 | 11/1983 | Japan . |
| 59-26745 | 2/1984 | Japan . |
| 60-102659 | 6/1985 | Japan . |
| 62-179548 | 7/1987 | Japan . |
| 62-181360 | 7/1987 | Japan . |

OTHER PUBLICATIONS

Patent Abstracts of Japan, vol. 5, No. 191, Dec. 5, 1981 & JP-A-56 114 978 (Tokyo Shibaura Denki K.K.), 09-09-1981.

Patent Abstracts of Japan, vol. 8, No. 38, Feb. 18, 1984 & JP-A-58 190 968 (Canon K.K.), 08-11-1983.

Patent Abstracts of Japan, vol. 9, No. 253, Oct. 11, 1985 & JP-A-60 102 659 (Canon K.K.), 06-06-1985.

*Primary Examiner*—Fred L. Braun

*Attorney, Agent, or Firm*—Staas & Halsey

[57] ABSTRACT

A process unit to be loaded into an image forming apparatus, includes at least a photosensitive drum to be rotated and a conductive brush type charger for uniformly charging a surface of the photosensitive drum. The conductive brush fibers having tips which touch the surface of the photosensitive drum and apply a charge voltage of 500 V to 1,500 V to the surface of the photosensitive drum through the conductive brush fibers for uniformly charging the surface of the photosensitive drum.

16 Claims, 17 Drawing Sheets

PROCESS UNIT FOR IMAGE FORMING APPARATUS, INCLUDING A CHARGING BRUSH

BACKGROUND OF THE INVENTION

The present invention relates to a process unit to be loaded into an image forming apparatus. The process unit is a unit, for processing image formation, which makes the maintenance of the image forming apparatus simple and easy because the process unit.

An image forming apparatus such as an electrophotographic copying apparatus or printer comprises the following units for processing image formation: a photosensitive drum consisting of a cylindrical base body, having an axis for rotating the cylindrical base body and a photosensitive layer mounted around the outer wall surface of the cylindrical base body; a charging unit for charging the photosensitive layer; a light irradiating unit for forming an electrostatic latent image on the photosensitive layer by irradiating a scanning light in an axial direction of the cylindrical base body in accordance with an electrical image signal; a developing unit for developing the electrostatic latent image on the photosensitive layer so as to form a toner image on the surface of the photosensitive layer in accordance with the latent image; a transfer unit for transcribing the toner image on an appropriate paper; an erasing unit for extinguishing the electrostatic latent image; and a cleaning unit for cleaning the toner left on the surface of the photosensitive layer.

As time passes, these units relating to the image formation are worn and become dirty, so that their characteristics and performance are changed and deteriorated respectively. Therefore, these units have to be cleaned or interchanged by an expert. Above all, the photosensitive unit and the charging unit are required to be interchanged. For solving this problems, some of these units, for example, the photosensitive drum and the charging unit are previously integrated into a unit called a "process unit", and the process unit is interchanged. Sometimes, the developing unit and the cleaning unit are also integrated into the process unit. As seen form the above, the light irradiating unit, the transfer unit and the erasing unit are not required to be integrated because these units are not required to be interchanged so often, so that these units are connected to a main body of the image forming apparatus and only apertures for these units are provided in the process unit. Because of providing this type of process unit, the problem of cleaning and interchanging the units and parts by the expert is eliminated, so that the maintenance of the image forming apparatus can to be performed by interchanging the process unit without calling the maintenance expert.

Usually, in the process unit of the prior art, a corona discharging type charger, which will be simply called a "corona charger" hereinafter, has been used in the charging unit. However, there has been a problem that the corona charger requires a high voltage, such as several kilovolts (kV) for corona discharging and ozone is generated during the corona discharging. Because of the necessity of the high voltage, a high voltage power supply must be provided on the main body of the image forming apparatus, resulting in increasing the size, weight and the cost of the image forming apparatus. And, because of the ozone generation, the photosensitive drum tends to be damaged, resulting in shortening the life of the photosensitive drum, therefore, shortening the life of the process unit. In the process unit using the corona charger, ozone protection means, such as an ozone filter and an ozone exhauster, for protecting the photosensitive drum from the ozone damage has been provided to the process unit. This ozone protection means is effective to prolong the life of the process unit; that is, by employing the ozone protection means, an average of 5,000 sheets can be copied by one process unit. However, this ozone protection means makes the process unit complicated, the size and weight of the image forming apparatus large and heavy respectively, and the cost of the process unit high. Furthermore, this means pollutes the air around the image forming apparatus by the exhausted ozone. The present invention intends to solve the above problems of the process unit.

The prior art process units have been disclosed in the following patents and publication:

U.S. Pat. No. 4,538,896 (1985);

U.S. Pat. No. 4,575,221 (1986); and

Japanese Unexamined Patent Publication (Kokai) No. 59-26745.

All of the above prior art process units include the corona charger. In this statement, the prior art process unit will be explained below with reference with U.S. Pat. No. 4,575,221.

FIG. 1 is a diagram for illustrating a prior art process unit 100 disclosed in U.S. Pat. No. 4,575,221. The process unit 100 is provided in the image forming apparatus, and includes a photosensitive drum 101, a corona charger 102, a developing unit 103 and a toner cleaner 104; wherein, the corona charger 102 is connected to a high voltage power supply 105 of the image forming apparatus, provided exteriorly to the process unit 100. The process unit 100 is effective for facilitating the operation and the maintenance of the image forming apparatus; however, as mentioned before, the corona charger 102 produces ozone, resulting in damaging the photosensitive drum 101. The photosensitive drum 101 is composed of a cylindrical base body 1012 and a photosensitive layer 1011 provided around the outer wall surface of the cylindrical base body 1012. The photosensitive layer 1011 is made of inorganic sensitive material such as zinc oxide or a selenium compound. However, recently organic photosensitive material composed of organic compound tends to be applied to the photosensitive layer 1011 instead of the inorganic photosensitive material. This is because the inorganic photosensitive material is injurious to the human body, so that the process unit using the inorganic photosensitive material as the photosensitive layer 1011 cannot be disposed freely. In contrast, the organic photosensitive material is not injurious, so that the process unit using the organic photosensitive material for the photosensitive layer 1011 can be disposed any place. Moreover, the cost of the organic photosensitive material is lower than that of the inorganic one. However, there is a problem in that the organic photosensitive material is easily damaged by ozone. Consequently, the prior art process unit using the corona charger has the following problems:

1) because of ozone generation, the photosensitive layer is easily damaged;

2) because of ozone generation, the life of the photosensitive layer cannot be made very long even though the generated ozone is exhausted from the process unit, resulting in decreasing the life of the process unit;

3) because of ozone generation, the air around the image forming apparatus is polluted when the generated ozone is exhausted from the process unit;

4) because of ozone generation, the economical, non-injurious and easily disposable organic photosensitive material is hard to be applied to the photosensitive layer;

5) because a high voltage power supply must be provided in to the image forming apparatus, the size, weight and cost of the image forming apparatus cannot be reduced; and 6) because the prior art process unit uses the corona charger, it is essentially hard to charge the photosensitive layer uniformly because a clogging problem occurs in the corona discharging when time passes, producing an irregular charge on the photosensitive layer.

SUMMARY OF THE PRESENT INVENTION

Therefore, it is an object of the present invention to solve the problems of the prior art process unit, occurring due to the corona charger.

An object of the present invention is to make the life of the photosensitive layer long, resulting in extending the life of the process unit.

Another object of the present invention is to provide a process unit which does not pollute the air around the image forming apparatus by ozone.

A further object of the present invention is to allow a process unit to be disposed freely any place, without concern over a that the photosensitive material polluting the environment.

A still further object of the present invention is to fabricate an image forming apparatus which is small in size and light in weight by excluding the high voltage power supply for the charging unit from the image forming apparatus.

Yet another object of the present invention is to fabricate a process unit having a simple construction by excluding the ozone filter and exhauster from the process unit.

Still another object of the present invention is to form a stable image at low cost.

The above objects are accomplished by applying a conductive brush type charger, which will be simply called a "brush charger" hereinafter, to the charging unit in the process unit instead of the corona charger and by applying the organic photosensitive material to the photosensitive layer in the process unit instead of the inorganic photosensitive material.

The brush of the brush charger is made of conductive material, and the photosensitive layer can be charged by making the brush touch the surface of the photosensitive layer and applying 500 V to 1,500 V to the surface through the brush. Accordingly, the brush charger does not require as high a voltage as the corona charger does, so that ozone is not generated. Therefore, the organic photosensitive material can be applied to the photosensitive layer, which results in: prolonging the life of the photosensitive drum, therefore, prolonging the life of the process unit; keeping the air around the image forming apparatus clean; allowing the process unit to be disposed freely; making the structure of the process unit simple; making the process unit and the image forming apparatus small in size and light in weight, respectively, because the ozone protection means is not required to be provided in the process unit and the high voltage power supply is not required to be provided in the main body of the image forming apparatus; lowering the cost of the process unit and the image forming apparatus respectively; and the photosensitive layer can be charged uniformly because the brush charger does not produce the clogging phenomenon.

BRIEF DESCRIPTION OF THE DRAWINGS

FIG. 7(*b*) a graph of charged potential distributed on a surface of a photosensitive drum along the axial direction of the photosensitive drum in a prior art process unit having a corona charter;

FIG. 10(*b*) is cross-sectional view of a fourth modification of the process unit of the present invention including a drum, a brush charger, a developing unit and a brush cleaner;

FIG. 11(*b*) is a side view schematically showing the electric connection of the process unit according to of FIG. 11(*b*) the second embodiment of the present invention in the electrophotographic printing apparatus;

FIG. 13(a) is a schematic cross-sectional view of a process unit according to a fourth embodiment of the invention, when the process unit is removed from a electrophotographic printing apparatus;

FIG. 15(*b*) is a side view schematically showing the internal structure of an electrophotographic printing apparatus using the process unit according to a the fifth embodiment of the present invention;

DETAILED DESCRIPTION OF THE PREFERRED EMBODIMENTS

The preferred embodiments of a process unit of the image forming apparatus, such as the electrophotographic printing apparatus, will be disclosed below.

Figure 1:
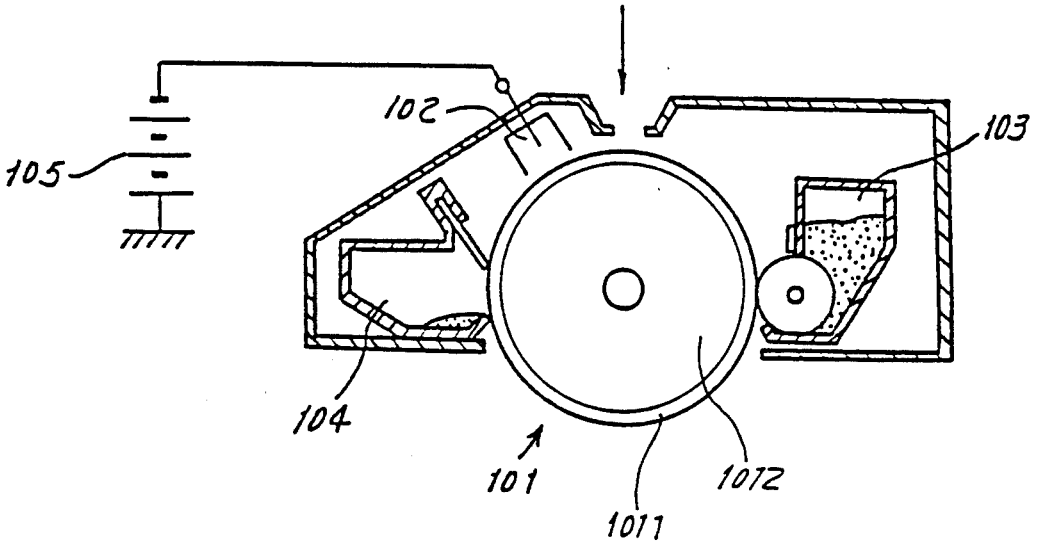
FIG. 1 PRIOR ART
FIG. 1 is a schematic cross-sectional view illustrating a prior art process unit.
Figure 2:
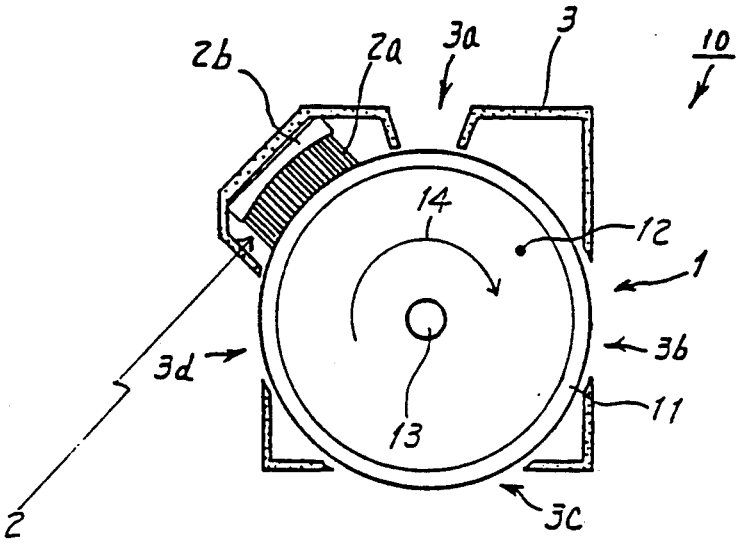
FIG. 2 a cross-sectional view schematically showing a process unit according to a first embodiment of the present
Figure 3:
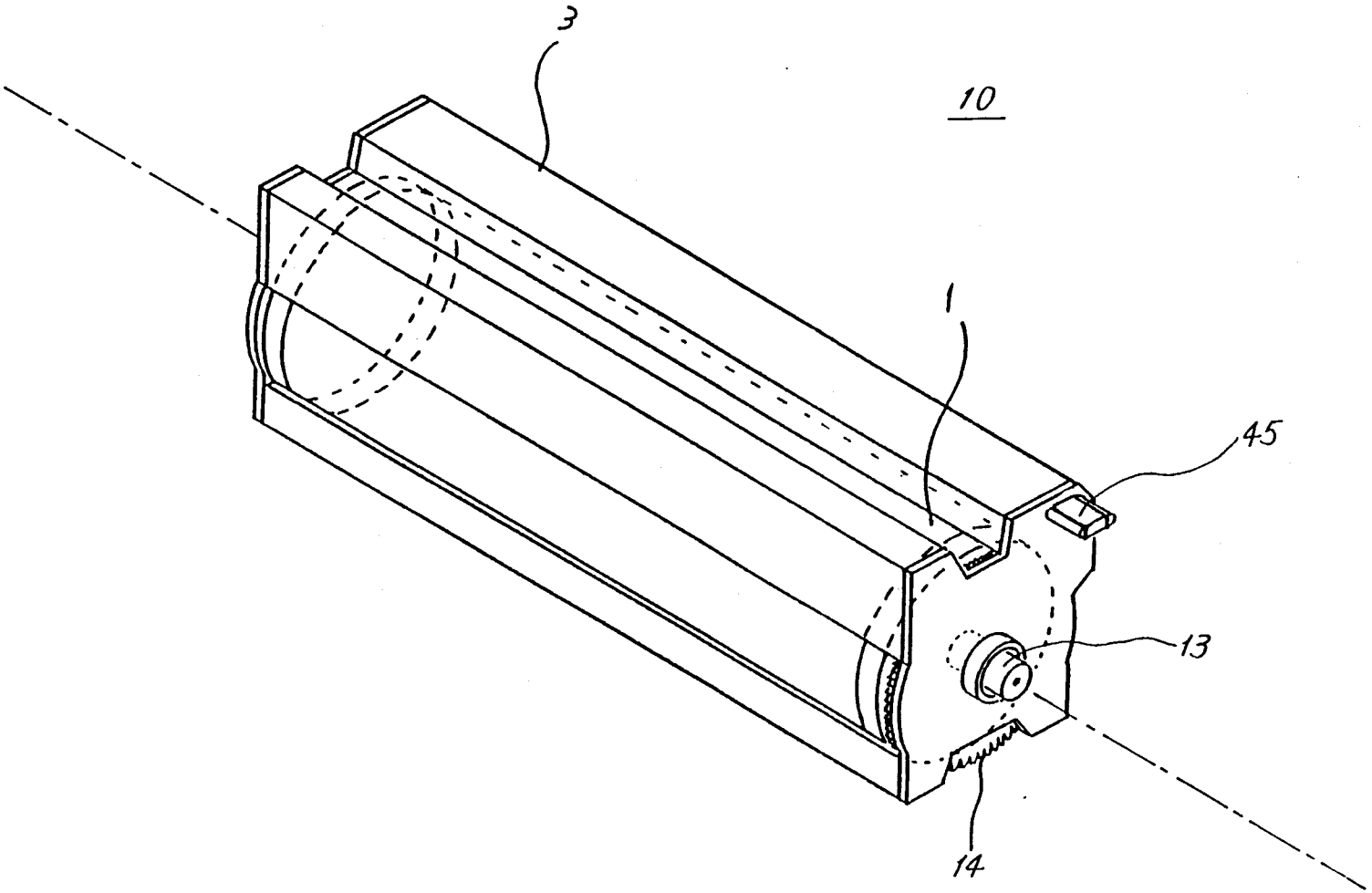
FIG. 3 is a perspective view of a process unit according to a first embodiment of the present invention.
Figure 4:
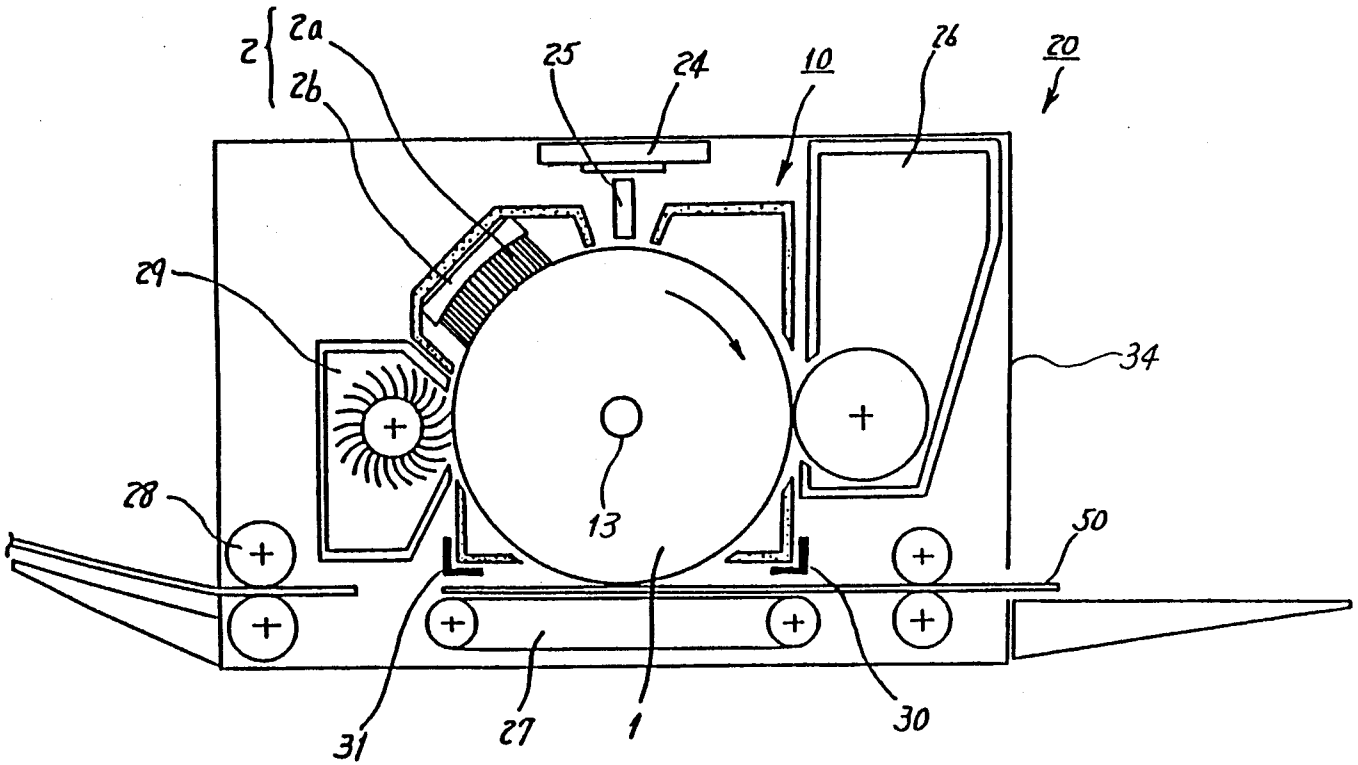
FIG. 4 is a side view schematically showing the internal structure of an electrophotographic printing apparatus using in a process unit according to a first embodiment of the present invention.
Figure 5:
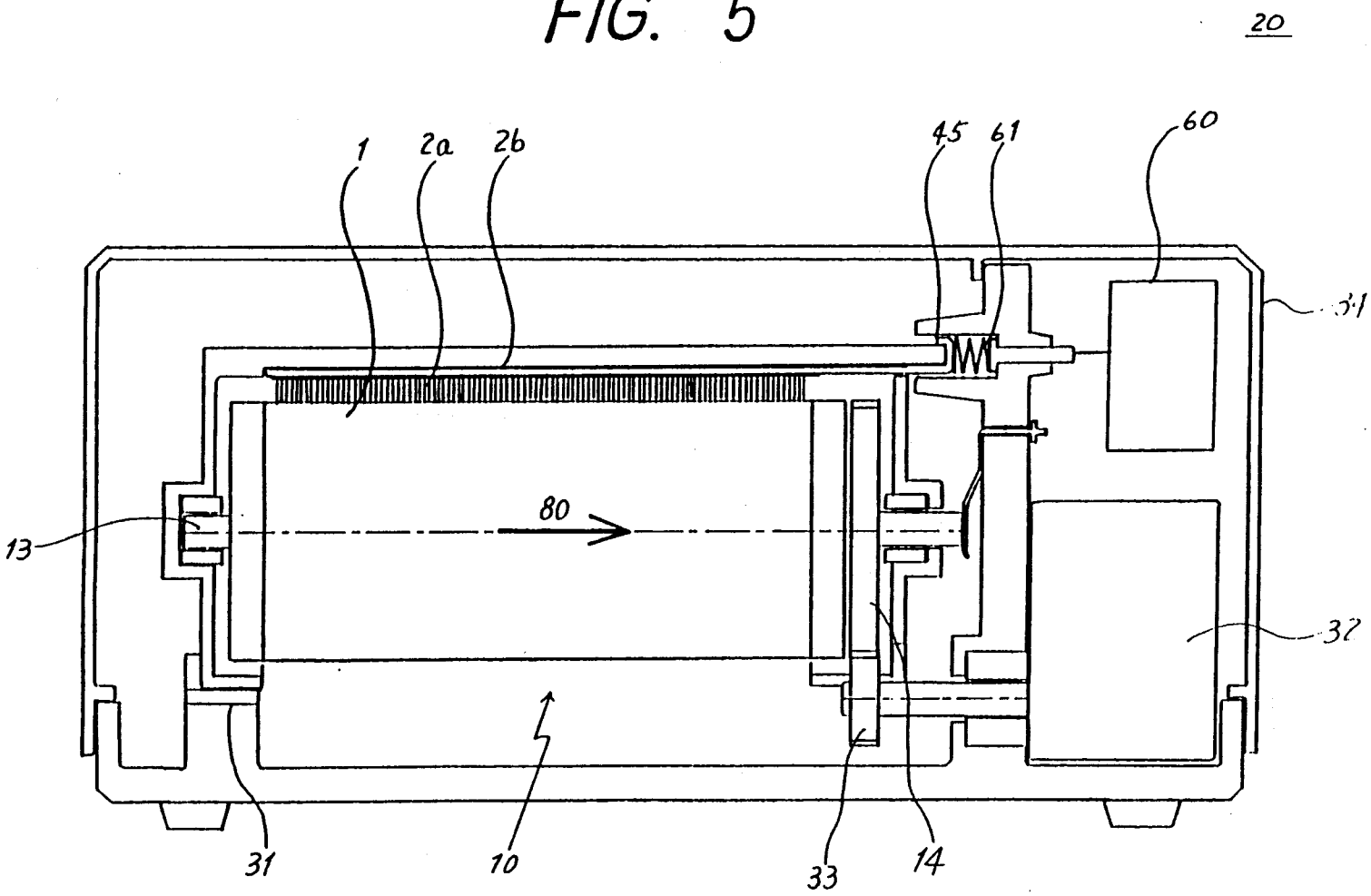
FIG. 5 is view schematically showing the electric connection of a process unit according to a first embodiment of the present invention in the electrophotographic printing apparatus.

FIG. 2 is a diagram for illustrating a first process unit embodying the present invention. FIG. 3 is a perspective view of the first process unit of FIG. 2. FIGS. 4 and 5 illustrate the constitution of the first process unit loaded into the photographic printing apparatus, respectively showing a cross-sectional view in FIG. 4 and a side view in FIG. 5. In FIGS. 2, 3, 4 and 5, the same reference numerals designate units or parts the same.

In FIG. 2, a process unit 10 comprises a unit case 3, a conductive brush type charger (brush charger) 2 fixed to an inner surface of the unit case 3 and a photosensitive drum 1 housed in the unit case 3. The photosensitive drum 1 consists of a cylindrical base body 12 rotating in a direction 14 around an axis 13 and a photosensitive layer 11 mounted around the outer peripheral wall of the cylindrical base body 12. The details of the process unit 10 will be explained later with reference to FIG. 4.

The brush charger 2 consists of a conductive base 2*b* which will be simply called a "base 2*b*" hereinafter, and a conductive brush 2*a* which will be called a "brush 2*a*" hereinafter. The brush 2*a* consists of a plurality of brush fibers and the brush 2*a* is fixed to a curved surface of the base 2*b* so that each brush fiber stands approximately perpendicularly to the curved surface.

In former times, the photosensitive layer was hard to be charged uniformly by the brush charger. However, after the study of the brush charger, the photosensitive layer comes to be charged more uniformly than the case of the corona charger. The results of the study have been disclosed in Japan Patent Applications "(TOKUGAN) No. 662-179548" (filed July 17, 1987) and "(TOKUGAN) No. 62-181360" (filed July 21, 1987) both of which are invented by the same inventors as those of the present invention.

According to TOKUGAN 62-179548, the brush is fabricated by weaving a cloth made of carbon-dispersed chemical fibers such as carbon-dispersed rayon, acrylic or nylon, raising nap on the cloth, and the brush charger is fabricated by bonding the cloth to the base by a conductive adhesive so that the nap, consisting of a plurality of carbon-dispersed chemical fibers, stands perpendicularly to the base. A thickness and a length of each carbon-dispersed chemical fiber which will be simply called a brush fiber hereinafter, and a density of the brush fibers are very significant for obtaining the uniform charge on the photosensitive layer.

According to TOKUGAN No. 62-181360, a voltage applying to the brush and the current flowing through each brush fiber, in other words, the resistance of each brush fiber, are very significant for obtaining the uniform charge on the photosensitive layer.

As disclosed in the above patents, the brush charger is critical as to the length and the thickness of the brush fiber and the density of the brush fibers. Particularly, the distance between the surface of the base of the brush charger and the surface of the photosensitive drum is very critical to obtain stable and uniform charge on the surface of the photosensitive drum. Therefore, the usage of the brush charger in the process unit is more effective to realize the uniform charge on the surface of the photosensitive drum, compared with the individually interchangeable brush charger. Because, since the brush charger in this invention is packed in the process unit, the critical distance can be previously determined and fixed in the fabrication of the process unit.

In the present invention, the brush charger packed in the process unit is fabricated based on the above studies.

In FIG. 3, the photosensitive drum 1 is fixed to the unit case 3 by the axis 13 of the photosensitive drum 1 and rotated around the axis 13. A driving unit 32, provided in the main body of the electrophotographic printing apparatus, which will be shown in FIG. 5, drives the photosensitive drum 1 through a gear train consisting of gears 14 and 33.

FIG. 4 schematically illustrates a side view of the internal structure of an electrophotographic printing apparatus 20 in which the first process unit is loaded. The electrophotographic copying apparatus 20 has a light emitting diode (LED) array 24 for light irradiation, rod lens array 25 for focusing the light onto the surface of the photosensitive drum 1, a developing unit 26 for developing an electrostatic latent image on the surface of the photosensitive drum 1 so as to produce a toner image thereon, a transfer belt 27 is to transcript the toner image onto an appropriate sheet 50, a fixing device 28 to fix the toner image by heating the sheet 50, a cleaner 29 is to remove toner left on the surface of the photosensitive drum 1 and angle structure 30 and 31 is for sliding and positioning the process unit 10 in the electrophotographic printing apparatus 20.

The process unit 10 is loaded in the electrophotographic printing apparatus 20 so that the process unit 10 is set on the angle structure 30 and 31 which is used as a guide rail placed in parallel with the axis 13 of the photosensitive drum 1.

FIG. 5 is a side view schematically illustrating the electrophotographic printing apparatus 20 in which the first process unit 10 is loaded, particularly in which electric connection of the first process unit to the electrophotographic printing apparatus 20 is shown. When the process unit 10 is loaded, an electrical contact 45 attached to the process unit 10 (see also FIG. 3) is connected to a spring contact 61 provided on the side of the electrophotographic printing apparatus 20, so that the conductive base 2b of the brush charger 2 is connected to a power supply 60 generating 500V to 1,500V and the surface of the photosensitive layer 11 can be charged. Thus, by using lower than 1,500 V for the charging voltage, there is no possibility to generate ozone. In FIG. 5, the photosensitive drum 1 is rotated by a driving unit 32 through a gear train consisting of gears 33 and 14. After taking off a cover 34 of the electrophotographic printing apparatus 20, the process unit 10 is loaded into the main body of the electrophotographic printing apparatus so as to be slid on the angle structure 30 and 31 in a direction 80.

Figure 6:
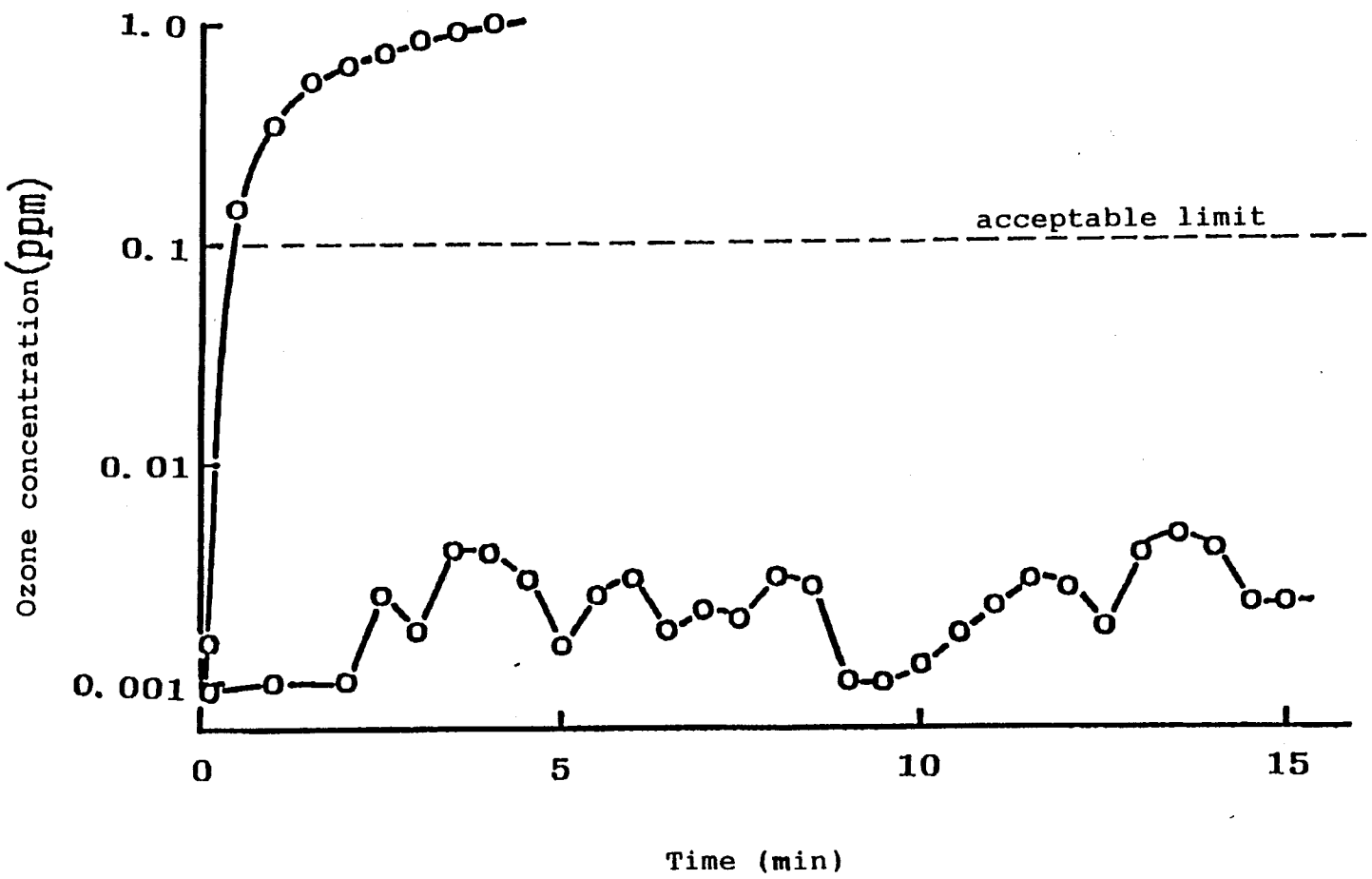
FIG. 6 is a graph of the variation of the concentration of ozone when time passes, comparing the cases of using brush charger as the present invention and the corona charger as in the prior art.

The variation of the concentration of ozone with time is shown in FIG. 6, comparing the cases of the present invention and the prior art using the corona charger. As in FIG. 6, the concentration of ozone in the case of the brush charger is sufficiently smaller than an acceptable limit of 0.1 ppm.

Before the charging characteristic of the photosensitive drum 1 is deteriorated because of the toner adhering to the brush fibers and the brush fibers being weakened due to the compression added to the brush fibers so as to touch the surface of the photosensitive drum, the process unit 10 is interchanged with a new one. The interchange is performed after printing several thousand to several ten thousand of the transcribing sheets 50.

Figure 7:
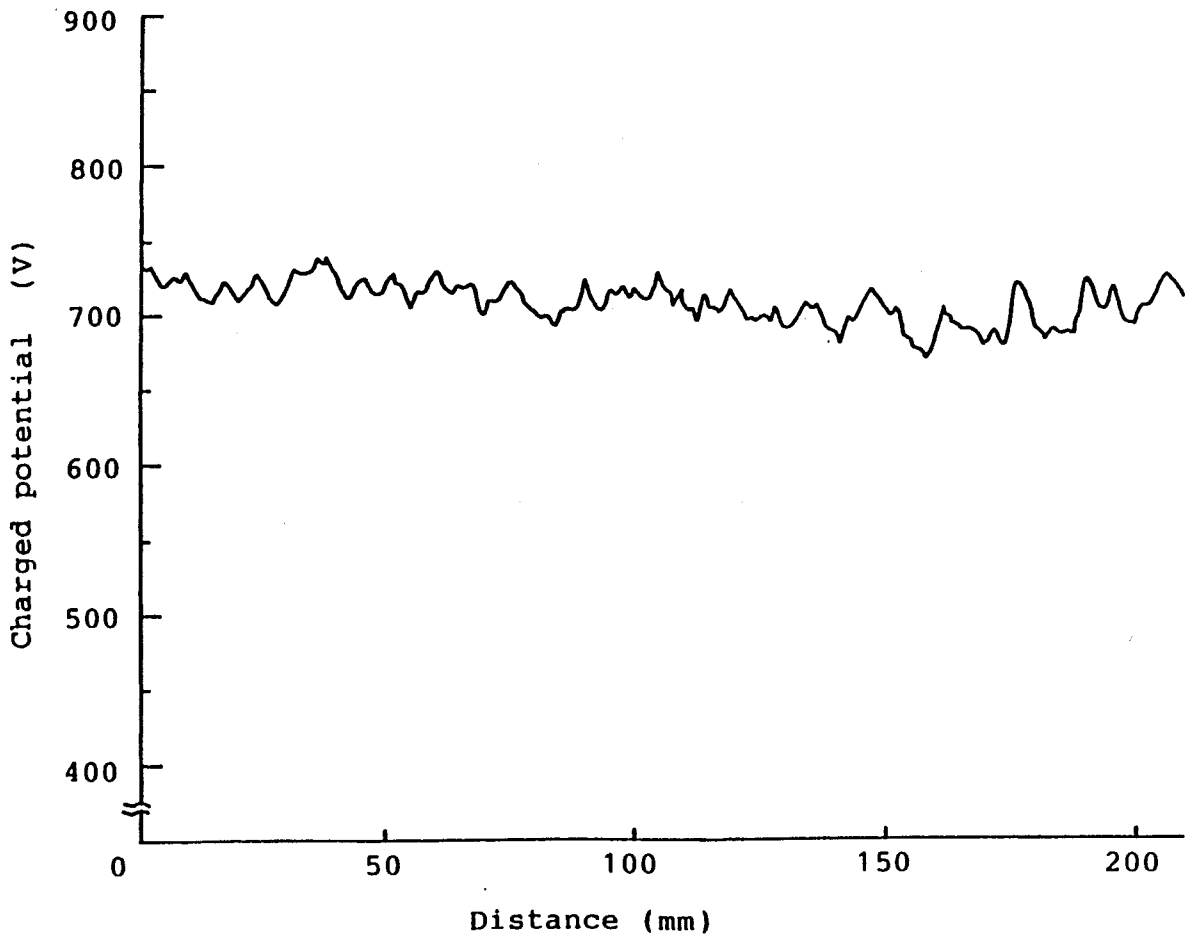
FIG. 7(*a*) a graph of charged potential distributed on a surface a photosensitive drum along the axial direction of the photosensitive drum, obtained by a brush charger packed in the process unit of the present invention.
Figure 7:
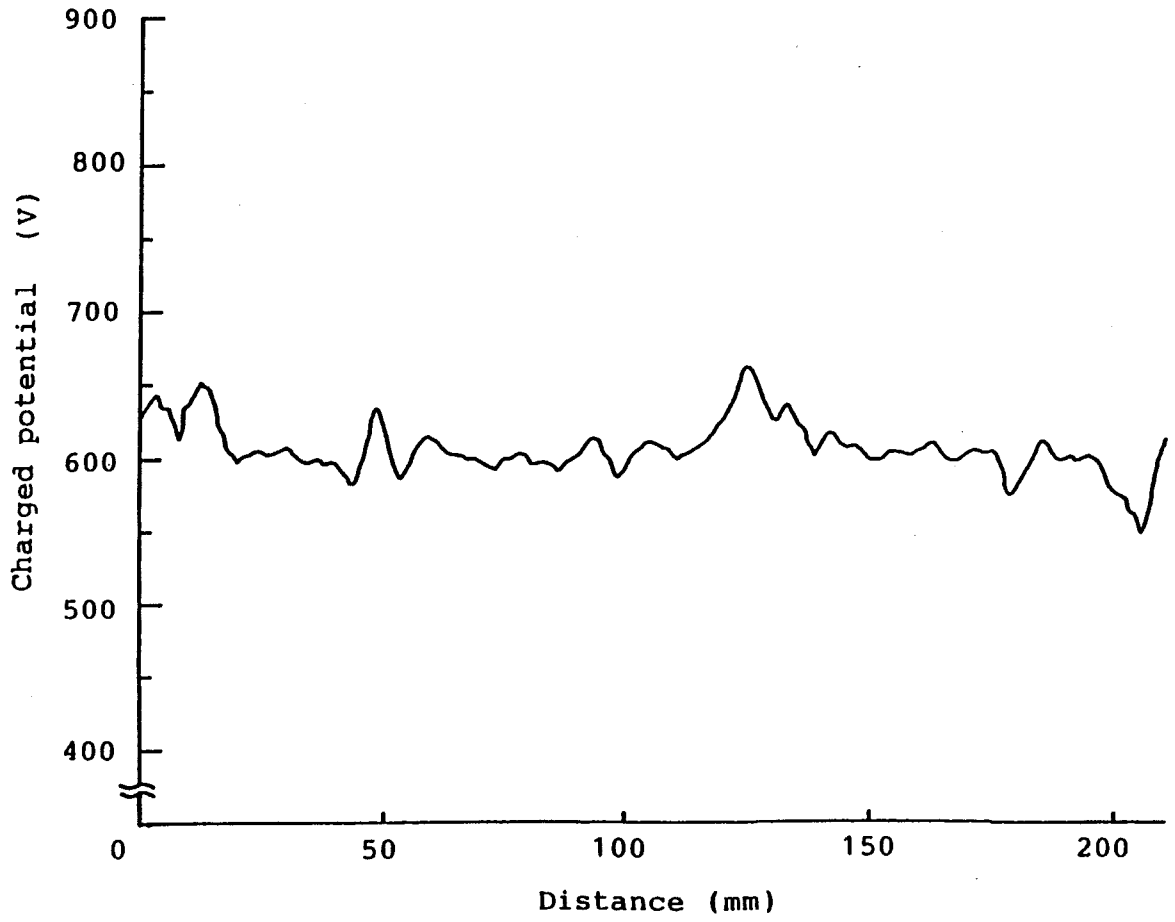

Distribution of potential charged by the brush charger is shown in FIG. 7(*a*), compared with that by the corona charger shown in FIG. 7(*b*). In FIGS. 7(*a*) and 7(*b*), the charged potential is plotted with distance on the surface of the photosensitive drum 1 measured an appropriate point along the axial direction of the photosensitive drum 1. As seen in FIGS. 7(*a*) and 7(*b*), the charge distribution produced by the brush charger is more uniform than that produced by the corona charger.

Figure 8:
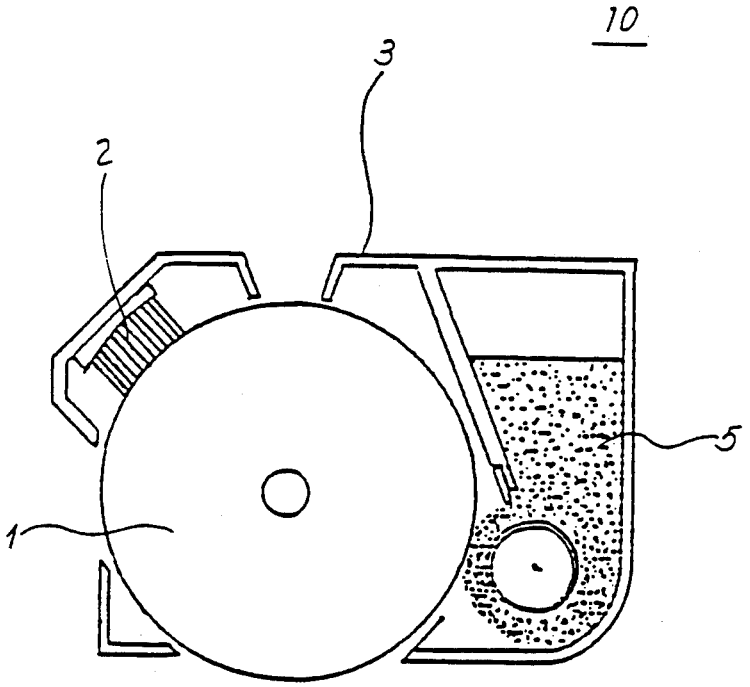
FIG. 8 is a cross-sectional view of a first modification of the process unit of the present invention including a photosensitive drum, a brush charger and a developing unit.
Figure 9:
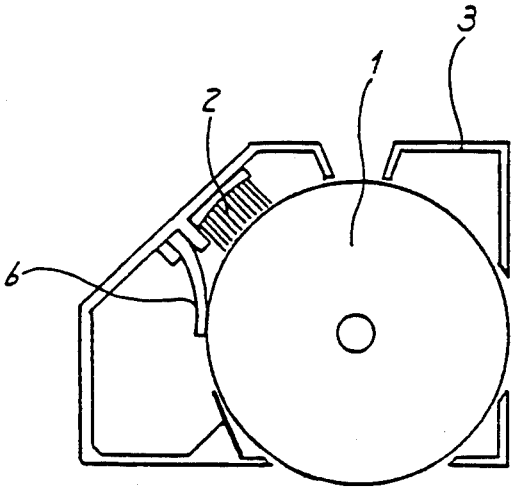
FIG. 9 is a cross-sectional is view of a second modification of the process unit of the present invention including a photosensitive drum, a brush charger and a cleaner.
Figure 10:
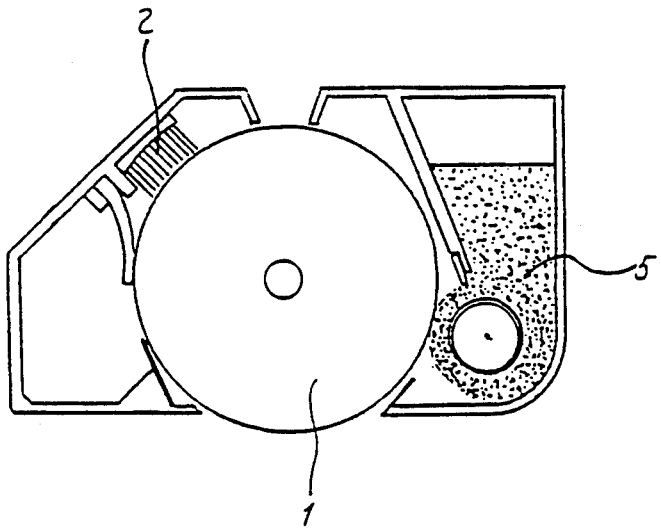
FIG. 10(*a*) is a cross-sectional view of a third modification of the process unit of the present invention including a photosensitive drum, a brush charger, a developing unit and a blade cleaner.
Figure 10:
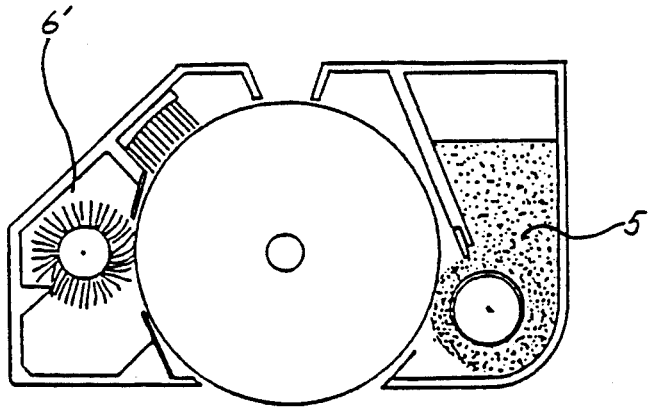

The first process unit includes the photosensitive drum 1 and the brush charger 2; however, a developing unit and a cleaner can be added to the process unit as shown in FIGS. 8, 9, 10(*a*) and 10(*b*). In FIGS. 8, 9, 10(*a*) and 10(*b*), the same reference numerals as in FIG. 2 designate the same units or parts as in FIG. 2.

A modified first process unit including the photosensitive drum 1, the brush charger 2 and a developing unit 5 in the unit case 3 is shown in FIG. 8; a modified first process unit including the photosensitive drum 1, the brush charger 2 and a blade cleaner 6 in the unit case 3 is shown in FIG. 9; a modified first process unit including the photosensitive drum 1, the brush charger 2, the developing unit 5 and the blade cleaner 6 in the unit case 3 is shown in FIG. 10(*a*); and a modified first process unit including the photosensitive drum 1, the brush charger 2, the developing unit 5 and a brush cleaner 6' in the unit case 3 is shown in FIG. 10(*b*).

Figure 11:
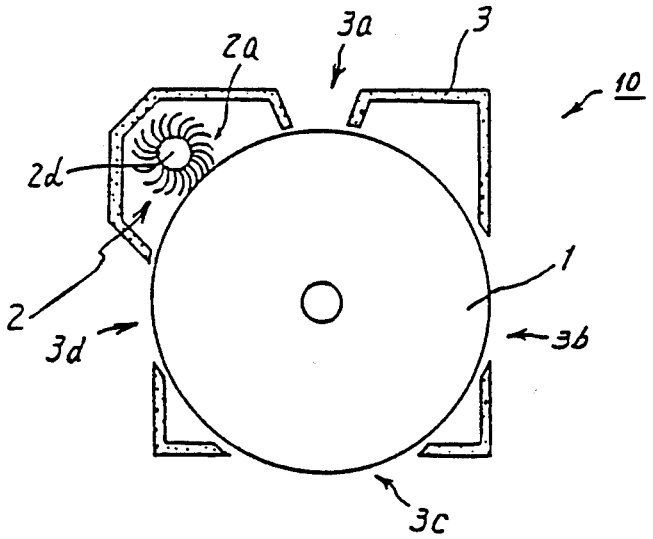
FIG. 11(*a*) is a cross-sectional view, schematically showing a process unit according to a second embodiment of the present invention.

A cross-sectional view of a second process unit embodying the present invention is shown in FIG. 11(*a*), and a side view of the second process unit is illustrated in FIG. 11(*b*). Particularly, the electric connection of the second process unit to the electrophotographic printing apparatus is shown in FIG. 11(*b*). In FIGS. 11(*a*), the same reference numerals as in FIG. 2 designate the same units or parts as in FIG. 2, and in FIG. 11(*b*), the same reference numerals as in FIG. 5 designate the same unit or parts as in FIG. 5.

In the second process unit, the brush charger 2 is rotated around an axis 2d placed in parallel with the axis 13 of the photosensitive drum 1. This rotating type brush charger 2, has a feature that the fibers of the brush 2a are not contaminated by toner left on the surface of the photosensitive drum 1 and are not weakened by a strong compression during long operation.

Figure 12:
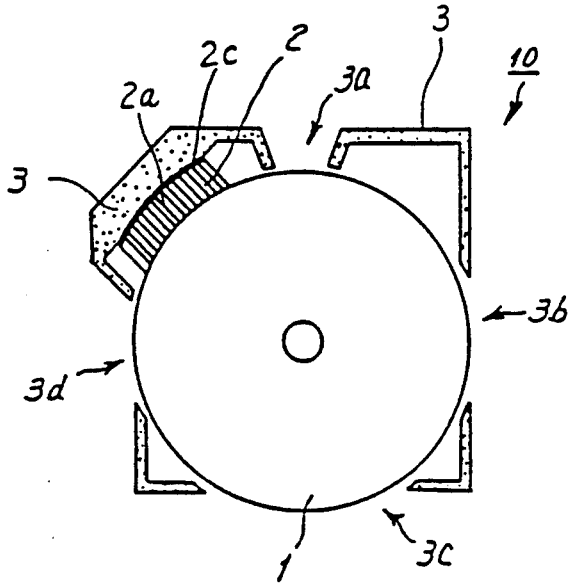
FIG. 12 is a cross-sectional view, schematically showing a process according to a third embodiment of the present invention.
Figure 11:
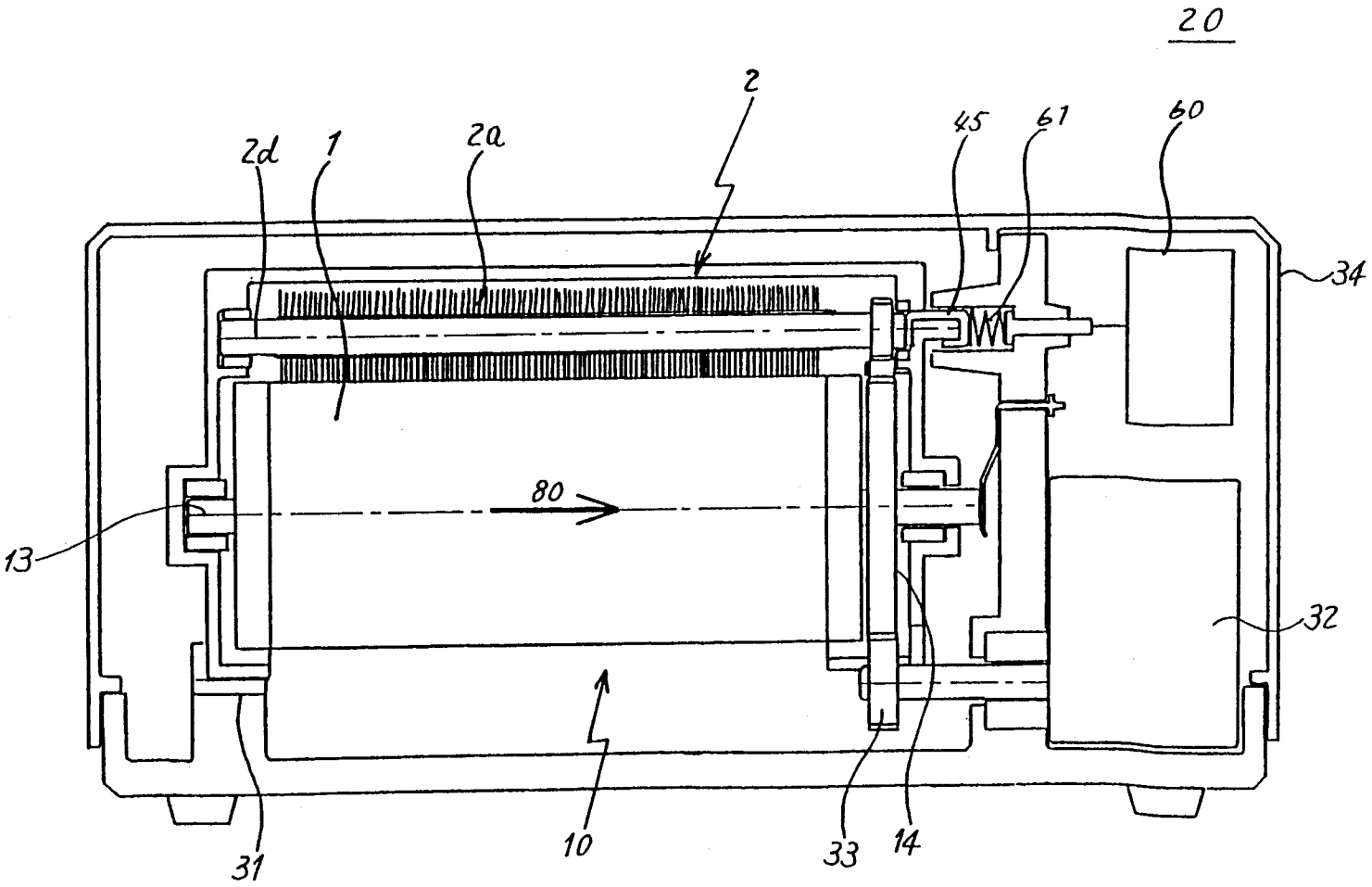

FIG. 12 shows a schematic cross-sectional view of a third process unit embodying the present invention. In FIG. 12, the same reference numerals as in FIG. 2 designate the same units or parts as in FIG. 2. In the third process unit, the charging unit 2 consists of a conductive layer 2c made of a conductive paint painted on the inner surface of the unit case 3 and the conductive brush is 2a provided on the conductive layer 2c so that the brush fibers stand approximately perpendicularly to the conductive layer 2c and the tips of the brush fibers touch the surface of the photosensitive drum 1.

In the third process unit, several modifications can be performed in the same way as the first process unit.

The third process unit has the advantages of low cost and small size because the brush charger 2 does not have the conductive base 2b.

Figure 13:
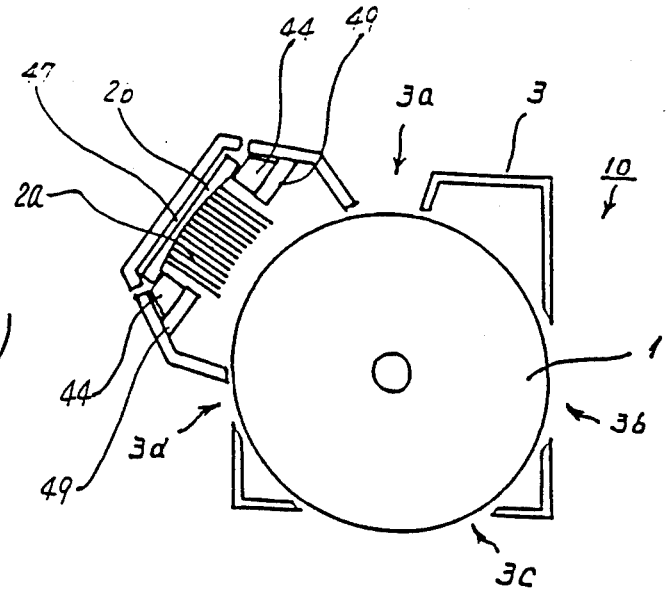
FIG. 13(*b*) is a schematic cross-sectional view of a process unit according to the fourth embodiment of the invention, when the process unit is loaded into an electrophotographic printing apparatus.
Figure 13:
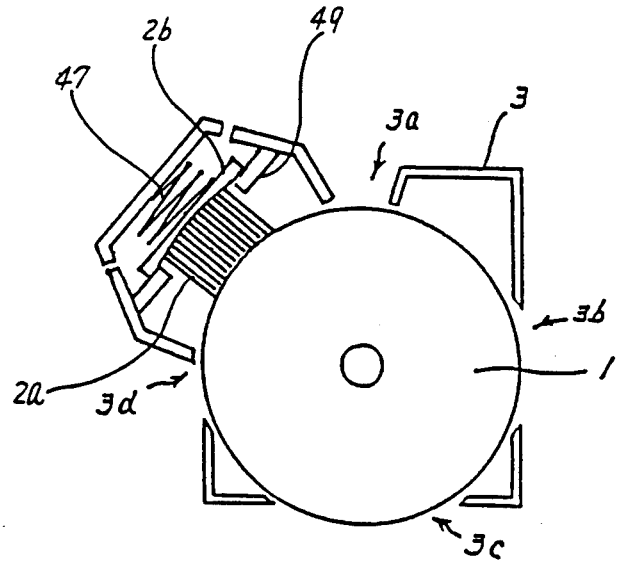

FIG. 13(*a*) is a schematic cross-sectional view of a fourth process unit embodying the present invention. In FIG. 13(*a*), the same reference numerals as in FIG. 2 designate the same units or parts as in FIG. 2.

In FIG. 13(*a*), the brush charger 2 is held by a spring 47 fixed to the inner surface of the unit case 3. When the process unit 10 is unloaded, for instance, for stock, the brush charger 2 is fixed to the unit case 3 by inserting a spacer 44, compressing the brush charger 2 toward the inner surface of the unit case 3 against elastic force of the spring 47, for separating the tips of the brush fibers of the brush 2a from the surface of the photosensitive drum 1. This is to avoid the brush fibers being weakened by the long touch of the tips to the surface of the photosensitive drum 1.

When the fourth process unit 10 is loaded in the electrophotographic printing apparatus, the spacer 44 is manually removed from the electrophotographic printing apparatus after the fourth process unit 10 is loaded, so that the brush charger 2 is automatically pushed toward the photosensitive drum 1 by the elastic force of the spring 47 until the base 2b is stopped by a stopper 49 internally provided to the unit case 3. Wherein, the brush charger 2 is positioned by the stopper 49 so that the tips of the brush fibers uniformly touch the surface of the photosensitive drum 1. Thus, the spring 47 acts as a thrust means for pushing the base bar 2b toward the surface of the photosensitive drum 1.

Figure 14:
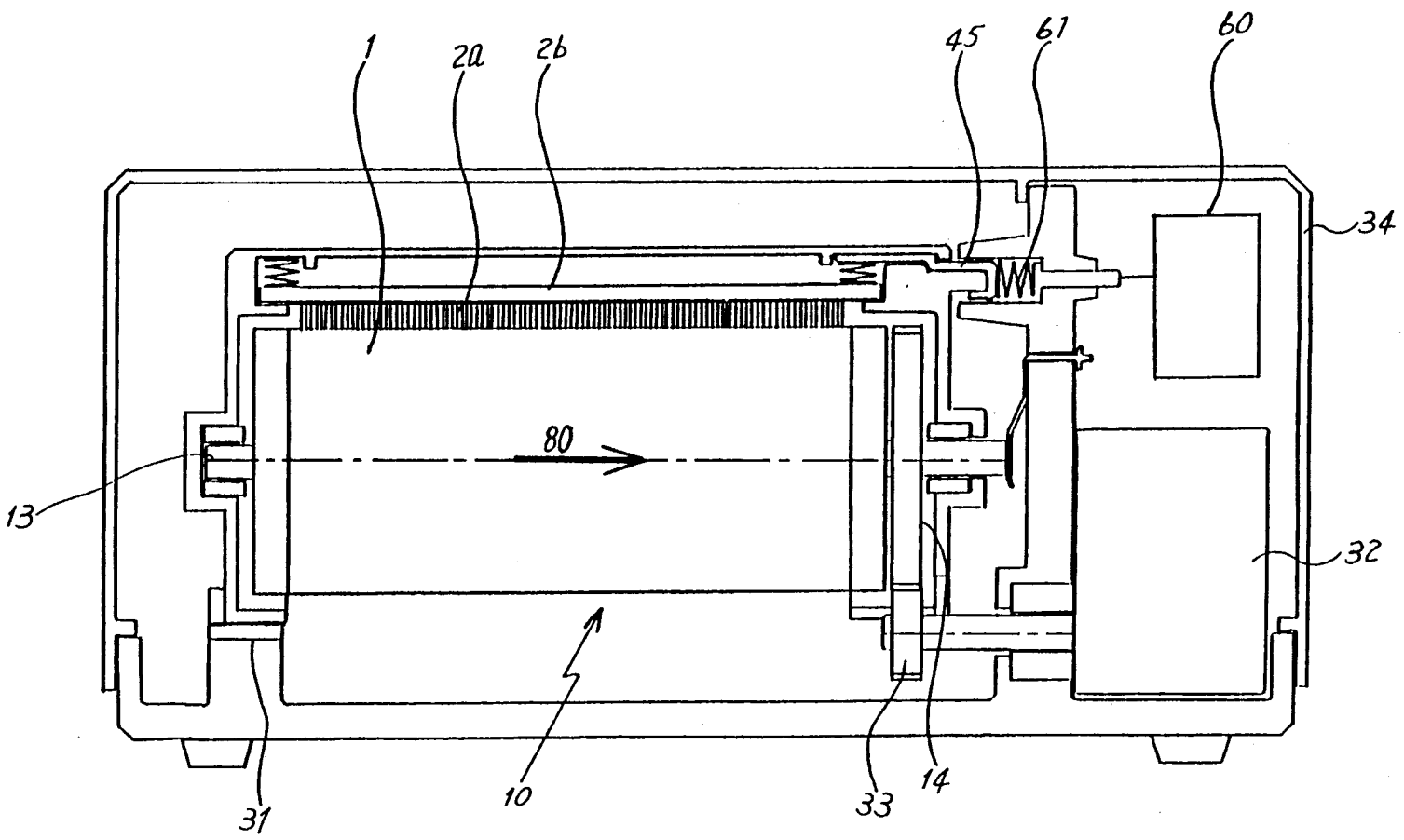
FIG. 14 is a side view schematically showing the internal structure of an electrophotographic printing apparatus using the process unit according to a fourth embodiment of the present invention.
Figure 15:
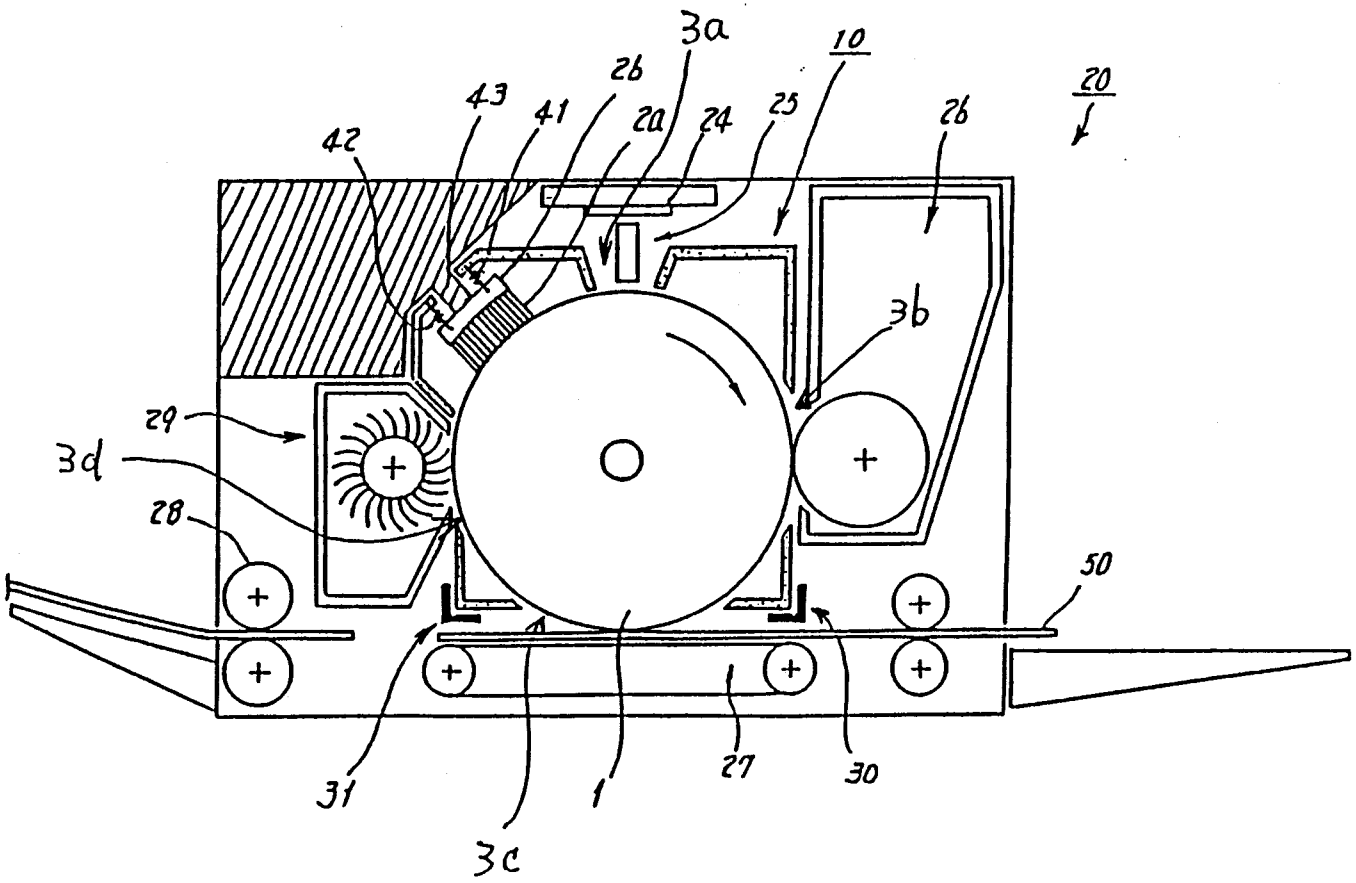

FIG. 14 is a side view schematically showing the internal structure of an electrophotographic printing apparatus to which the fourth process unit 10 is loaded. In FIG. 14, the same reference numerals as in FIG. 11(*b*) designate the same units or parts as in FIG. 11(*b*).

According to the fourth process unit 10, the life of the brush charger 2 is sufficiently long because the tips of the brush fibers do not touch the surface of the photosensitive drum 1 while the fourth process unit 10 is stocked.

Figure 15:
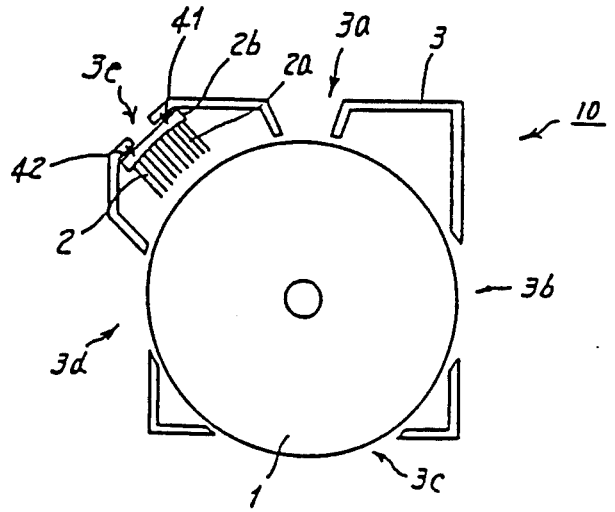
FIG. 15(*a*) is a schematic cross-sectional view of a process unit according to a fifth embodiment of the present invention.

FIG. 15(*a*) is a schematic cross-sectional view of the fifth process unit embodying the present invention. FIG. 15(*b*) is a side view schematically showing the internal structure of an electrophotographic printing apparatus to which the fifth process unit is loaded. In FIG. 15(*a*), the same reference numerals as in FIG. 2 designate the same units or parts as in FIG. 2.

In the fifth process unit 10, the base 2b is pulled toward the inner surface of the unit case 3 by springs 41 and 42 fixed to the inner surface of the unit case 3. Thus, springs 41 and 42 act as a pulling means for pulling the base 2b outward from the surface of the photosensitive drum 1. So, before the fifth process unit 10 is unloaded in the electrophotographic copying apparatus, the tips of the conductive brush fibers of the brush charger 2 are spaced from the surface of the photosensitive drum 1. The unit case 3 of the fifth process unit has an aperture 3e at the place where the base bar 2b is provided.

A cross-sectional view illustrating the internal constitution of the fifth process unit 10 is shown in FIG. 15(*b*). In FIG. 15(*b*), the same reference numerals as in FIG. 4 designate the same units or parts as in FIG. 4.

In the FIG. 15(*b*), the LED 24 and the rod lens array 25, the developing unit 26, the transfer belt 27 and the cleaner 29 are provided in the main body of the electrophotographic printing apparatus 20, corresponding to the apertures 3a, 3b, 3c and 3d respectively. Meanwhile, the electrophotographic printing apparatus 20 has a protruding portion 43 which is in sliding contact with a surface of base 2b, positions the tips of the conductive brush fibers of the conductive brush 2a to touch the surface of the photosensitive drum 1, when the process unit is loaded into the electrophotographic printing apparatus 20.

Figure 16:
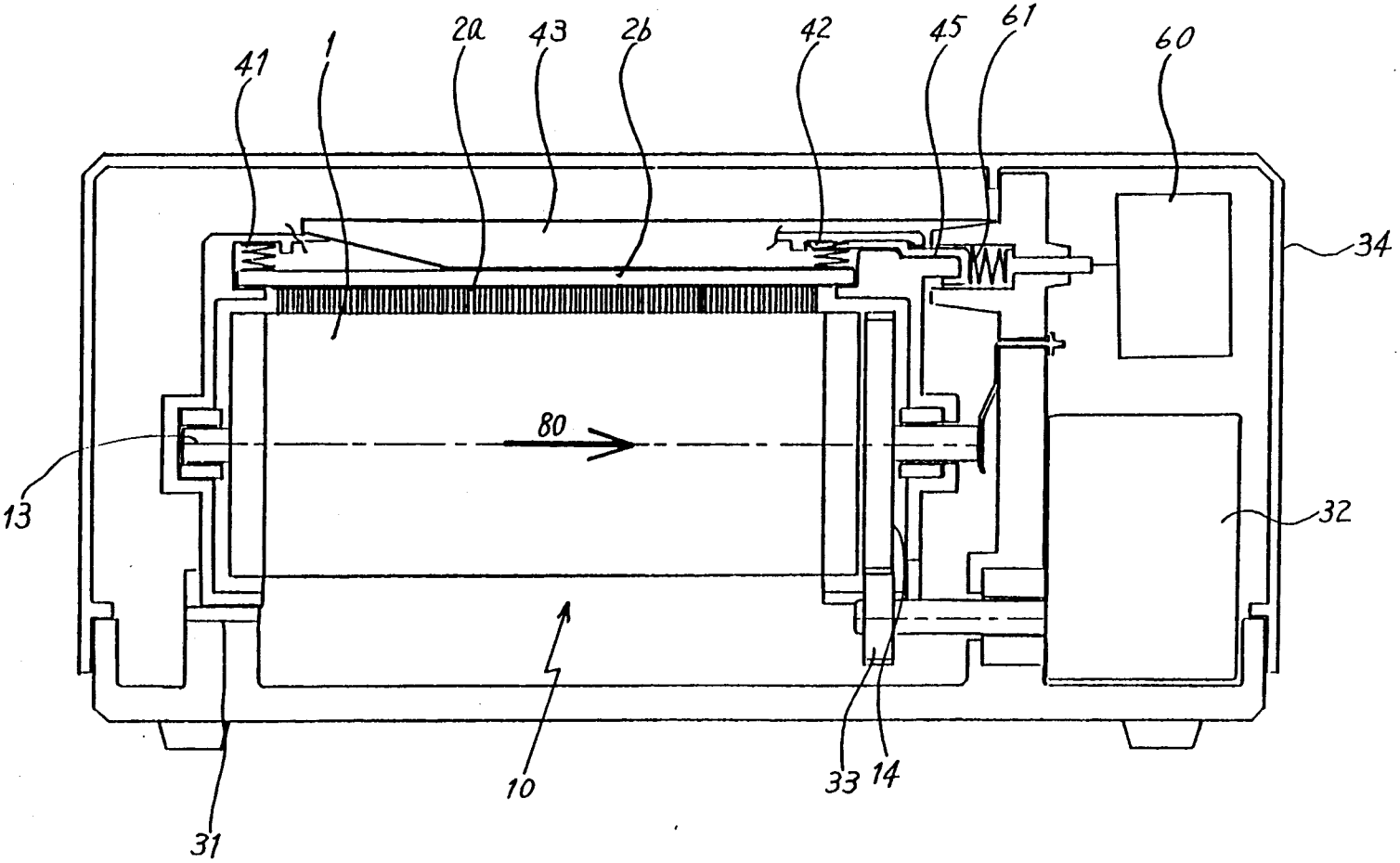
FIG. 16 is a side view schematically showing the internal an electrophotographic printing apparatus using the process unit according to the fifth embodiment of the present invention.

FIG. 16 is a side view schematically showing the internal structure of an electrophotographic printing apparatus to which the fifth process unit 10 is loaded. In FIG. 16, the same reference numeral as in FIG. 5 designates the same unit or part as in FIG. 5.

When the fifth process unit is loaded into the electrophotographic printing apparatus 20, the protruding portion 43 is relatively slid into the process unit 10, contacting the base bar 2b through the aperture 3e and pushing the bar 2b toward the photosensitive drum 1 against the elastic force of the springs 41 and 42. This makes the tips of the conductive brush fibers of the conductive brush 2a uniformly touch the surface of the photosensitive drum 1. The protruding portion 43 is beveled at an inlet side looking from the loading process unit 10 so as to make the insertion of the process unit smooth.

The fifth process unit has an advantage over the fourth process unit in that fifth process unit can be loaded only by inserting the process unit into the electrophotographic printing apparatus; it is not necessary to remove the spacer as the fourth process unit.

The fifth process unit 10 includes the photosensitive drum 1 and the brush charger 2. However, it is possible to add other processing units such as the developing unit and the cleaner.

Figure 17:
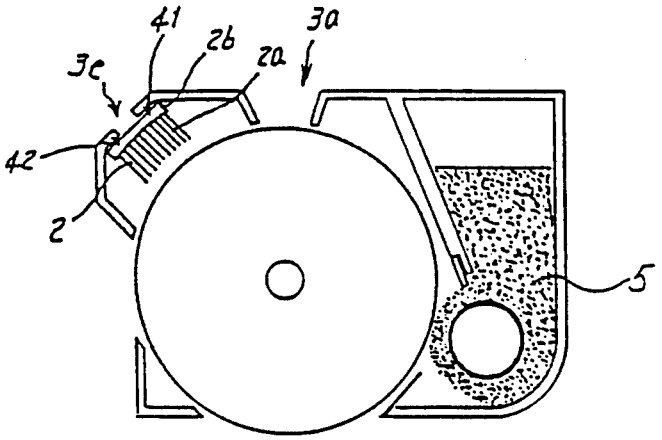
FIG. 17 is a schematic cross-sectional view of a process unit according to the fifth embodiment of the present invention, including a developing unit besides a photosensitive drum and a brush charger.

A schematic cross-sectional view of the fifth process unit including a developing unit 5 besides the photosensitive drum 1 and the brush charger 2 is shown in FIG. 17. In FIG. 17, the same reference numerals as in FIG. 8 designate the same units or parts as in FIG. 8.

Figure 18:
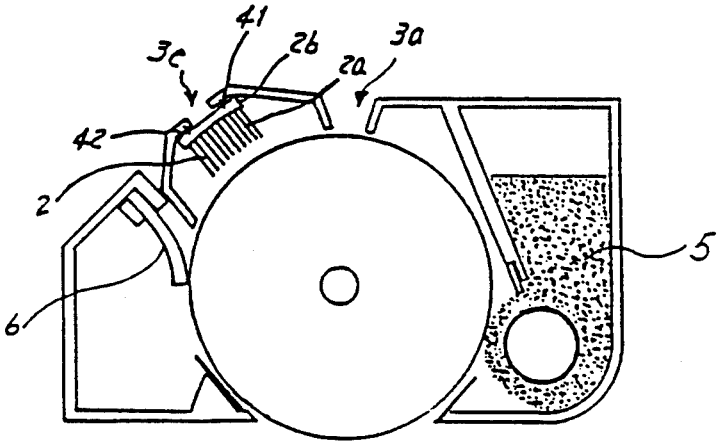
FIG. 18 is a schematic cross-sectional view of a process unit according to a fifth embodiment of the present invention, including a developing unit and a cleaner besides a photosensitive drum and a brush charger.

A schematic cross-sectional view of the fifth process unit including a developing unit 5 and a cleaner 6 besides the photosensitive drum 1 and the brush charger 2 is shown in FIG. 18. In FIG. 18, the same reference numerals as in FIG. 9 designate the same units or parts as in FIG. 18.

Figure 19:
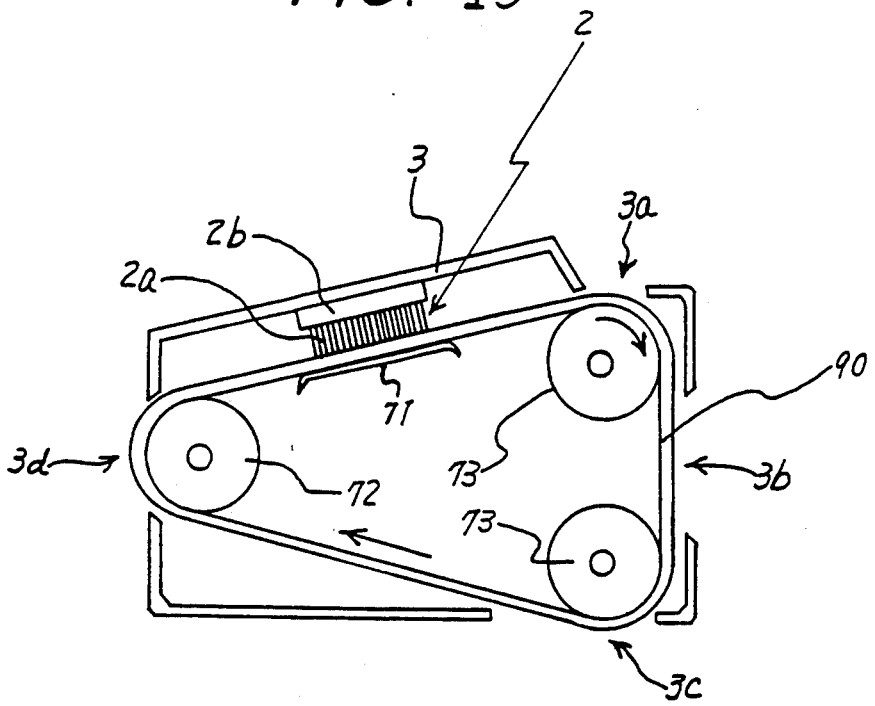
FIG. 19 is a cross-sectional view schematically showing a modification of the process unit of the present invention, including a photosensitive belt instead of a photosensitive drum.

In the above first to fifth embodiments of the present invention, the photosensitive drum 1 is used in the respective process unit. However, the present invention can be applied not only to the process unit using the photosensitive drum but also to that using a photosensitive belt as the photosensitive member, as shown in FIG. 19. In FIG. 19, the same reference numeral as in FIG. 2 designates the same unit or part as in FIG. 2. In FIG. 19, a photosensitive belt 90 is drived by a driving roller 72 so as to go round, passing through guide rollers 73, and the brush 2a is touched to the surface of the photosensitive belt 90 passing on a surface of a sustainer 71 made of conductive material such as stainless steel. The photosensitive belt 90 is made of polyethylene terephthalate on which aluminum is evaporated, forming an aluminum layer on which organic photosensitive material is painted by a dipping method.

What is claimed is:

1. A process unit to be loaded in or unloaded from an image forming apparatus, comprising:

a photosensitive member having a surface and transferred in a first direction;

a conductive brush type charger comprising a plurality of conductive brush fibers having tips, arranged in a second direction substantially perpendicular to the first direction, for electrostatically charging the surface of said photosensitive member uniformly by causing the tips of said conductive brush fibers to touch the surface of said photosensitive member and applying a charging voltage to the surface of said photosensitive member through said conductive brush fibers;

a unit case for housing said photosensitive member and said conductive brush type charger; and means for supporting said conductive brush type charger so as to position said tips of said conductive brush fibers out of contact with said surface of said photosensitive member, while said process unit is unloaded from said image forming apparatus.

2. A process unit according to claim 1, wherein said unit case has an inner surface, and wherein said conductive brush type charger further comprises a conductive base, fixed to said inner surface of said unit case, on which said conductive brush fibers are provided.

3. A process unit according to claim 1, wherein said photosensitive member is a photosensitive belt transferred in the first direction, said photosensitive belt comprising a belt body on which a conductive material is coated and a photosensitive layer provided on said conductive material.

4. A process unit according to claim 1, wherein said supporting means comprises a spacer.

5. A process unit according to claim 1, wherein said supporting means comprises a spring.

6. An image forming apparatus, comprising:

a process unit to be loaded in or unloaded from said image forming apparatus, said process unit including:

a photosensitive member having a surface which is transferred in a first direction;

a conductive brush ytpe charger comprising a plurality of conductive brush fibers having tips, arranged in a second direction substantially perpendicular to the first direction, for electrostatically charging the surface of said photosensitive member uniformly by causing the tipsof said conductive brush to touch the surface of said photosensitive member, and applying a charging voltage to the surface of said photosensitive member through said conductive brush fibers;

a unit case for housing said photosensitive member and said conductive brush type charger; and means for supporting said conductive brush type charger so as to position said tips of said conductive brush fibers out of contact which said surface of said photosensitive member, while said process unit is unloaded from said image forming apparatus;

image forming means for forming a toner image on said photosensitive member; and transfer means for transferring said toner image on said photosensitive member to a medium.

7. An image forming apparatus, comprising:

a process unit to be loaded in or unloaded from said image forming apparatus, said processing unit including:

a photosensitive member having a surface which is transferred in a first direction;

a conductive brush type charger comprising a plurality of conductive brush fibers having tips, arranged in a second direction substantially perpendicular to the first direction, for electrostatically charging the surface of said photosensitive member uniformly by causing the tips of said conductive brush to touch the surface of said photosensitive member, and applying a charging voltage to the surface of said photosensitive member through said conductive brush fibers;

a unit case for housing the photosensitive member and said conductive brush type charger; and means for supporting said conductive brush type charger so as to position said tips of said conductive brush fibers out of contact with said surface of said photosensitive member, while said process unit is unloaded from said image forming apparatus;

image forming means for forming a toner image on said photosensitive member;

transfer means for transferring said toner image on said photosensitive member to a medium; and positioning means for positioning said conductive brush type charger so as to position said tips of said conductive brush fibers in contact which said surface of said photosensitive member, when said image forming means forms a toner image on said photosensitive member.

8. A process unit to be loaded in or unloaded from an image forming apparatus, comprising:

a photosensitive member having a surface and transferred in a first direction;

a conductive brush type charger comprising a plurality of conductive brush fibers having tips, arranged in a second direction substantially perpendicular to the first direction, for electrostatically charging a surface of said photosensitive member uniformly by making the tips of said conductive brush fibers touch the surface of said photosensitive member and applying a charging voltage to the surface of said photosensitive member through said conductive brush fibers;

developing means for developing an electrostatic latent image so as to form a toner image on the surface of said photosensitive member for transcription on a sheet;

cleaner means for cleaning toner left on the surface of said photosensitive member after the transcription of the toner image on the sheet;

a unit case for housing said photosensitive member, said conductive brush type charger, said developing means and said cleaner means, so that said photosensitive member, said conductive brush type charger, said developing means and said cleaner means are loaded in or unloaded from said image forming apparatus by loading or unloading said unit case; and means for supporting said conductive brush type charger so as to position said tips of said conductive brush fibers out of contact with said surface of said photosensitive member, while said process unit is unloaded from said image forming apparatus.

9. A process unit according to claim 8, wherein said photosensitive member is a photosensitive drum comprising a conductive rotating drum having a wall surface rotated in the first direction and a photosensitive layer provided around the wall surface of the conductive rotating drum.

10. A process unit according to claim 8, wherein said photosensitive member is a photosensitive belt transferred in the first direction, said photosensitive belt comprising a belt body on which a conductive material is coated and a photosensitive layer provided on said conductive material.

11. A process unit according to claim 8, wherein the conductive brush fibers are carbon-dispersed chemical fibers.

12. A process unit to be loaded in or unloaded from an image forming apparatus, comprising:

a photosensitive member having a surface and transferred in a first direction;

a conductive brush type charger comprising a plurality of conductive brush fibers having tips, arranged in a second direction substantially perpendicular to the first direction, for electrostatically charging the surface of said photosensitive member uniformly by causing the tips o said conductive brush fibers to touch the surface of said photosensitive member and applying a charging voltage to the surface of said photosensitive member through said conductive brush fibers, said conductive brush type charger further comprising:

a conductive base bar on which said conductive brush fibers are provided, said base bar being positioned substantially perpendicular to the first direction;

thrust means for pushing said base bar toward the surface of said photosensitive member;

stopper means for stopping said base bar against the thrust force of said thrust means so that the tips of the conductive brush fibers uniformly touch the surface of said photosensitive member; and spacer means insertable between said base bar and said stopper means, for providing a space between the tips of said conductive brush fibers and the surface of said photosensitive member, said spacer means being removable; and a unit case for housing said photosensitive member and said conductive brush type charger.

13. A process unit to be loaded in an image forming apparatus having a bar with a second sliding surface protruding therefrom, comprising:

a photosensitive member having a surface and transferred in a first direction;

a conductive brush type charger including:

a plurality of conductive brush fibers having tips, arranged in a second direction substantially perpendicular to the first direction, for electrostatically charging a surface of said photosensitive member uniformly by causing the tips of said conductive brush fibers to touch the surface of said photosensitive member and applying a charging voltage to the surface of said photosensitive member through said conductive brush fibers;

a conductive base bar on which said conductive brush fibers are provided, so that said conductive brush fibers are directed toward the surface of said photosensitive member, said conductive base bar being arranged in the second direction and positioned substantially in parallel with the surface of said photosensitive member, said conductive base bar comprising a first sliding surface substantially parallel to the surface of said photosensitive member for positioning said conductive base bar so that the tips of said conductive brush fibers uniformly touch the surface of said photosensitive member by contacting the second sliding surface on the bar which protrudes from the image forming apparatus, when said process unit is loaded into the image forming apparatus; and pulling means for pulling said conductive base bar outward from the surface of said photosensitive member, providing a space between the tips of said conductive brush fibers and the surface of said photosensitive member when said process unit is removed from the image forming apparatus, said pulling means always making tight contact between the first and second sliding surfaces when said process unit is loaded into the image forming apparatus; and a unit case for housing said photosensitive member and said conductive brush type charger.

14. A process unit according to claim 13, wherein said photosensitive member is a photosensitive drum comprising a conductive rotating drum having a wall surface, rotated in the first direction and a photosensitive layer provided around the wall surface of the conductive rotating drum.

15. A process unit according to claim 13, wherein said photosensitive member is a photosensitive belt transferred in the first direction, said photosensitive belt comprising a belt body on which a conductive material is coated and a photosensitive layer provided on said conductive material.

16. A process unit according to claim 13, wherein said conductive brush fibers are carbon-dispersed chemical fibers.

* * * * *

UNITED STATES PATENT AND TRADEMARK OFFICE

CERTIFICATE OF CORRECTION

PATENT NO. : 5,060,016

DATED : October 22, 1991

INVENTOR(S) : Masahiro Wanou, et al

It is certified that error appears in the above-identified patent and that said Letters Patent is hereby corrected as shown below:

Col. 1, line 10, "unit." should be --unit can be interchanged--;
line 42, "form" should be --from--;
line 52, "to" should be deleted.

Col. 3, line 30, "that the" should be deleted.

Col. 4, line 16, "in" should be deleted;
line 18, "is view" should be --is a side view--;
line 24, "as the" should be --as in the--;
line 26, "7(a) a" should be --7(a) is a --;
line 27, "surface a " should be --surface of a--;
line 31, "7(b) a" should be --7(b) is a--;
line 39, "is" (second occurrence) should be deleted:
line 49, "a drum" should be --a photosensitive drum--;
line 55, "unit according to of" should be --unit of FIG. 11 (b) according to--;
line 56, "FIG.11(b)" should be deleted;
line 59, "process" should be --process unit--;

Col. 5, line 10, "a" should be deleted;

UNITED STATES PATENT AND TRADEMARK OFFICE
CERTIFICATE OF CORRECTION

PATENT NO. : 5,060,016

DATED : October 22, 1991

INVENTOR(S) : Masahiro Wanou, et al

It is certified that error appears in the above-identified patent and that said Letters Patent is hereby corrected as shown below:

Col. 5, Line 13, "internal an" should be --internal structure of an--;
Line 41, "designate units or parts the same" should be --designate the same units or parts--;
Line 65, "662-179548" should be 62-179548--.

Col 7, line 68, "unit" should be --units--.
Col 10, line 57, "ytpe" should be --type--;
Col 12, line 14, "face should be --face,--;
line 35, "o" should be --of--.

Signed and Sealed this

Sixth Day of April, 1993

*Attest:*

STEPHEN G. KUNIN

*Attesting Officer*

*Acting Commissioner of Patents and Trademarks*